US010677081B2

(12) United States Patent
Jones et al.

(10) Patent No.: US 10,677,081 B2
(45) Date of Patent: Jun. 9, 2020

(54) AXIAL FLOW MACHINE

(71) Applicant: ROLLS-ROYCE plc, London (GB)

(72) Inventors: Alan R. Jones, Derby (GB); Gareth J. Jones, Derby (GB); Gary Eadon, Derby (GB)

(73) Assignee: Rolls-Royce plc, London (GB)

( * ) Notice: Subject to any disclaimer, the term of this patent is extended or adjusted under 35 U.S.C. 154(b) by 176 days.

(21) Appl. No.: 15/688,129

(22) Filed: Aug. 28, 2017

(65) Prior Publication Data

US 2018/0058235 A1 Mar. 1, 2018

(30) Foreign Application Priority Data

Aug. 31, 2016 (GB) ..... 1614711.8

(51) Int. Cl.

| | |
|---|---|
| ***F01D 11/00*** | (2006.01) |
| ***F01D 11/14*** | (2006.01) |
| ***F01D 11/16*** | (2006.01) |
| ***F01D 11/18*** | (2006.01) |
| ***F01D 9/04*** | (2006.01) |
| ***F01D 25/24*** | (2006.01) |

(52) U.S. Cl.

CPC ..... *F01D 11/005* (2013.01); *F01D 9/042* (2013.01); *F01D 11/14* (2013.01); *F01D 11/16* (2013.01); *F01D 11/18* (2013.01); *F01D 25/246* (2013.01); *F01D 9/041* (2013.01); *F05D 2240/11* (2013.01); *F05D 2240/55* (2013.01); *F05D 2260/30* (2013.01)

(58) Field of Classification Search

CPC ..... F01D 11/125; F01D 11/14; F01D 11/16; F01D 11/18; F01D 25/243; F05D 2240/11

See application file for complete search history.

(56) References Cited

U.S. PATENT DOCUMENTS 3,529,904 A * 9/1970 Borden ..... F01D 11/001 415/136
3,965,066 A * 6/1976 Sterman ..... F01D 9/023 60/800

(Continued)

FOREIGN PATENT DOCUMENTS

GB 1488481 10/1977
GB 2102897 2/1983

(Continued)

OTHER PUBLICATIONS

European Search Report dated Jan. 10, 2018, issued in EP Patent Application No. 17184873.

(Continued)

*Primary Examiner* — Kevin R Steckbauer
(74) *Attorney, Agent, or Firm* — Oliff PLC

(57) ABSTRACT

There is disclosed an axial flow machine (10) comprising an annular flow path (23); a stator ring (38) comprising a plurality of stators mounted at their radially outer ends and extending into the annular flow path (23); a non-rotating body (24) axially adjacent the stator ring (38); and an annular shroud (42) disposed between the radially inner end of the stator ring (38) and the body (24). The shroud (42) is supported on the stator ring (38) and moveable relative the body (24); and the shroud (42) cooperates with the body (24) to inhibit a flow through a clearance pathway (78) therebetween.

20 Claims, 3 Drawing Sheets

(56) References Cited

U.S. PATENT DOCUMENTS 4,184,689 A * 1/1980 Brodell ..... F16J 15/021 415/134
4,566,851 A * 1/1986 Comeau ..... F01D 25/246 415/139
5,197,856 A * 3/1993 Koertge ..... F01D 25/246 415/199.4
5,265,412 A * 11/1993 Bagepalli ..... F23R 3/60 60/800
5,553,999 A * 9/1996 Proctor ..... F01D 11/08 415/134
5,645,398 A 7/1997 Benoist et al.
5,749,218 A * 5/1998 Cromer ..... F02K 1/805 60/796
6,442,946 B1 * 9/2002 Kraft ..... F01D 9/023 60/796
6,547,257 B2 * 4/2003 Cromer ..... F01D 9/023 277/355
6,751,962 B1 * 6/2004 Kuwabara ..... F01D 9/023 60/752
7,217,089 B2 * 5/2007 Durocher ..... F01D 11/005 415/170.1
7,374,395 B2 * 5/2008 Durocher ..... F01D 9/04 415/115
7,527,469 B2 * 5/2009 Zborovsky ..... F01D 9/041 277/412
7,717,671 B2 * 5/2010 Addis ..... F01D 5/20 415/173.1
7,784,264 B2 * 8/2010 Weaver ..... F01D 9/023 60/39.37
8,092,159 B2 * 1/2012 Maldonado ..... F01D 5/186 29/889.721
8,585,357 B2 * 11/2013 DiPaola ..... F01D 25/246 415/173.6
8,622,693 B2 * 1/2014 Di Paola ..... F01D 25/246 415/116
8,740,551 B2 * 6/2014 Di Paola ..... F01D 25/246 415/116
8,888,445 B2 * 11/2014 Pruthi ..... F01D 9/023 415/174.1
9,010,127 B2 * 4/2015 Willis ..... F01D 9/023 60/806
9,115,808 B2 * 8/2015 Simmons ..... F16J 15/0887
9,366,444 B2 * 6/2016 Salunkhe ..... F01D 9/023
9,879,555 B2 * 1/2018 Moehrle ..... F01D 9/023
9,879,557 B2 * 1/2018 Hall ..... F01D 11/005
9,963,989 B2 * 5/2018 Banks ..... F01D 11/005
2002/0121744 A1 * 9/2002 Aksit ..... F01D 9/023 277/411
2002/0163134 A1 * 11/2002 Cromer ..... F01D 9/023 277/411
2006/0123797 A1 * 6/2006 Zborovsky ..... F01D 9/041 60/800
2006/0159549 A1 * 7/2006 Durocher ..... F01D 11/005 415/170.1
2008/0053107 A1 * 3/2008 Weaver ..... F01D 9/023 60/800
2008/0089783 A1 * 4/2008 Addis ..... F01D 5/20 415/170.1
2008/0166233 A1 * 7/2008 Johnson ..... B23P 6/002 415/230
2010/0247286 A1 * 9/2010 Maldonado ..... F01D 5/186 415/1
2011/0044801 A1 * 2/2011 Di Paola ..... F01D 9/04 415/173.1
2011/0044802 A1 * 2/2011 Di Paola ..... F01D 9/04 415/173.1
2011/0044803 A1 * 2/2011 Di Paola ..... F01D 9/04 415/173.1
2011/0044804 A1 * 2/2011 DiPaola ..... F01D 9/04 415/173.1
2012/0292860 A1 * 11/2012 Moehrle ..... F01D 9/023 277/640
2013/0209250 A1 * 8/2013 Simmons ..... F16J 15/0887 415/214.1
2013/0227964 A1 * 9/2013 Willis ..... F01D 9/023 60/806
2015/0128610 A1 * 5/2015 Salunkhe ..... F01D 9/023 60/800
2016/0047258 A1 * 2/2016 Hall ..... F01D 11/005 415/1
2016/0273376 A1 * 9/2016 Rioux ..... F01D 11/18
2017/0328230 A1 * 11/2017 Virkler ..... F01D 11/22
2019/0078457 A1 * 3/2019 Eastwood ..... F01D 11/14

FOREIGN PATENT DOCUMENTS

GB 2212223 7/1989
WO 2014152209 9/2014

OTHER PUBLICATIONS

Great Britian Search Report dated Nov. 11, 2016 issued in GB Patent Application No. 1614711.8.

* cited by examiner

AXIAL FLOW MACHINE

CROSS-REFERENCE TO RELATED APPLICATIONS

This application is based is based upon and claims the benefits of priority from British Application Number 1614711.8 filed 31 Aug. 2016, the entire contents of which are incorporated by reference.

BACKGROUND OF THE INVENTION

The invention relates to an axial flow machine comprising a stator ring, a non-rotating body and a shroud disposed therebetween.

BRIEF SUMMARY OF THE DISCLOSURE

The present disclosure concerns axial flow machines, such as gas turbine engines. Such machines typically comprise multiple compressor and turbine stages, each stage including a rotor and axially adjacent stator or vane within an annular flow path through the machine. The rotors are mounted to one or more shafts that rotate around an axial centreline of the machine and are supported, via bearings, by a support structure.

In some axial flow machines there is a stator disposed adjacent another non-rotating component, such as part of a support structure. It is known to provide a shroud between a stator and a support structure to inhibit gas flow therebetween from the annular flow path. Such shrouds may be subject to wear owing to differential thermal expansion between the respective components, and buffeting from the surrounding flow.

According to a first aspect there is provided an axial flow machine comprising: an annular flow path; a stator ring comprising a plurality of stators mounted at their radially outer ends and extending into the annular flow path; a non-rotating body axially adjacent the stator ring; an annular shroud disposed between the radially inner end of the stator ring and the body; wherein the shroud is supported on the stator ring and moveable relative the body; and wherein the shroud cooperates with the body to inhibit a flow through a clearance pathway therebetween.

The stator ring may be generally annular. The portion of the body with which the shroud cooperates may be generally annular.

A seal may be formed between the stator ring and the shroud. The shroud may comprise an anti-fret liner to form a seal between the shroud and the stator ring. There may be no liner between the shroud and the body. In particular, there may be no anti-fret liner therebetween.

The shroud may be radially moveable relative the stator ring.

The stator ring, shroud and body may be configured so that, when coaxially arranged, there is a first radial clearance between the stator ring and the shroud which is less than a second radial clearance between the shroud and the body. Accordingly, the range of movement of the shroud relative the stator ring is limited so that the clearance pathway between the shroud and body is maintained.

References herein to a radial clearance between components refer to the minimum radial clearance between the components. Accordingly, relative radial movement between the components corresponding to the radial clearance will cause them to abut. Similarly, references herein to radial clearances between surfaces refer to the minimum radial clearance between the respective surfaces. Accordingly, relative radial movement between the surfaces corresponding to the radial clearance will cause them to abut.

The axial flow machine may be configured so that, with the centre axis of the axial flow machine extending laterally, the shroud is supported on the stator ring so that it is offset from a coaxial arrangement with the stator ring in a substantially downward direction. In other words, the shroud may be supported in a dropped configuration.

The axial flow machine may be arranged so that the centre axis extends substantially horizontally.

The stator ring may comprise a radially inner platform defining a portion of the annular flow path, and the stator ring and shroud may be engaged radially inward of the platform by a cooperating radially extending flange and radially extending flange groove. The flange may be received in the flange groove along a radial direction. The flange and flange groove may extend circumferentially and radially inwardly. The flange may have a greater extent in the radial direction than the axial direction. The stator ring may comprise the flange, and the shroud may comprise the flange groove.

The shroud may comprise a circumferentially extending shroud support surface and the stator ring may comprise an opposing circumferentially extending stator support surface. The shroud may be offset from coaxial alignment with the stator ring so that at least part of the shroud support surface is supported on at least part of the stator support surface.

The stator support surface and shroud support surface may be axially adjacent the cooperating flange and flange groove. The shroud and stator ring may be configured so that there is a clearance between the radial end of the flange and the flange groove.

The shroud and stator ring may be configured so that there is a clearance between the radial end of the flange and the flange groove irrespective of the relative position of the shroud and stator ring. The shroud and stator ring may be configured so that, when coaxially arranged, the first radial clearance between the shroud support surface and the stator support surface is greater than a radial clearance between the radial end of the flange and the end of the flange groove. The radial end of the flange may be the distal end, in other words, the end farthest from the main part of the component of which it is an integral part.

A gas-washed surface of the platform defining the annular flow path may be inclined and/or curved relative the centre axis of the axial flow machine when viewed in radial cross-section, and the stator support surface may extend linearly and/or axially when viewed in radial cross-section.

The shroud may comprise a stator seal portion defining one of the flange and the flange groove. The shroud may comprise a shroud support portion extending axially away from the stator seal portion and configured to oppose and be supported on the stator ring. In other words, the shroud support portion may extend axially beyond the stator seal portion. The stator seal portion may define the flange groove, and the shroud support portion may extend axially away from a lip of the flange groove.

The shroud and body comprise opposing surfaces at least partly defining the clearance pathway therebetween, the opposing surfaces extending circumferentially. The opposing surfaces may oppose each other along a radial direction (i.e. with a radial clearance therebetween).

The stator ring, shroud and body may be configured so that, when coaxially arranged, the radial clearance between the shroud support surface and the stator support surface is less than the radial clearance between the opposing surfaces of the shroud and body which define the clearance pathway.

The shroud and body may comprise a rim and a cooperating rim groove which receives the rim, and the clearance pathway may be defined between the rim and rim groove. One of the shroud and body may comprise the rim, and the other may comprise the rim groove. The rim and rim groove may be annular, and the rim may be received in the rim groove along an axial direction. The rim may be received in the rim groove along a direction within 20 deg or less, 15 deg or less, 10 deg or less or 5 deg or less of the axial direction.

The opposing surfaces that define the clearance pathway may include radially inner and outer surfaces of the rim and opposing radially inner and outer surfaces of the rim groove respectively. The shroud may comprise the rim and the body may comprise the rim groove.

There may be an axial clearance between the distal end of the rim and the opposing end of the rim groove so that the rim groove can accommodate relative axial movement of the shroud relative the body.

The stator ring, shroud and body may be axially fixed with respect to each other. Alternatively, the stator ring may be axially moveable with respect to the body, for example owing to differential thermal expansion. For example, the stator ring may be mounted to a casing which expands at a different rate to the body, such that the stator ring moves axially with respect to the body. The shroud may be axially fixed with respect to the stator ring.

The body may be coupled to or part of an intercase extending through the annular flow path and to support a shaft of the axial flow machine.

There is also provided a gas turbine engine in accordance with the first aspect. The body may be coupled to or part of an intercase of the gas turbine.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

BRIEF DESCRIPTION OF THE SEVERAL VIEWS OF THE DRAWINGS

Embodiments will now be described by way of example only, with reference to the Figures, in which.

DETAILED DESCRIPTION

Figure 1:
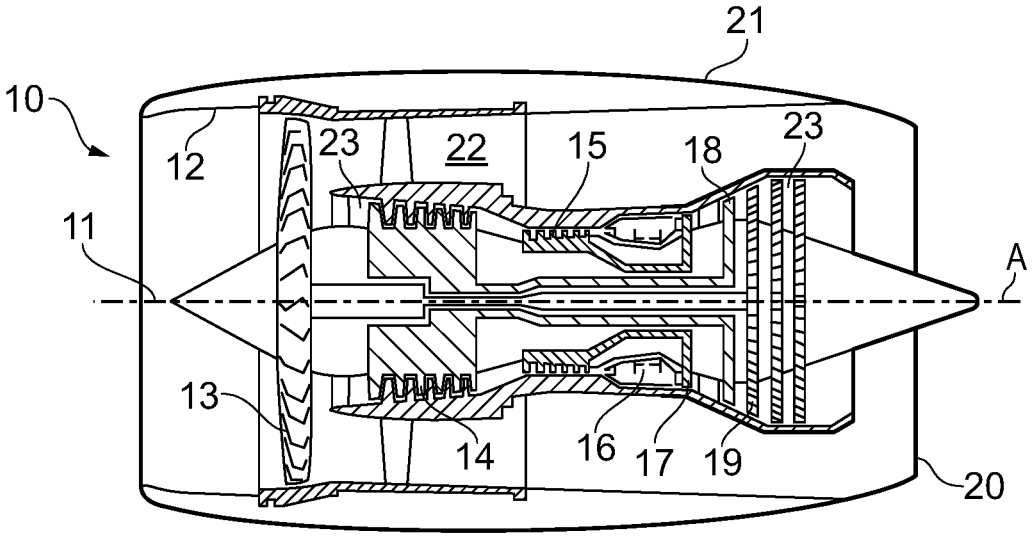
FIG. 1 is a sectional side view of a gas turbine engine.

With reference to FIG. 1, a gas turbine engine is generally indicated at 10, having a principal and rotational axis 11. The engine 10 comprises, in axial flow series, an air intake 12, a propulsive fan 13, an intermediate pressure compressor 14, a high-pressure compressor 15, combustion equipment 16, a high-pressure turbine 17, an intermediate pressure turbine 18, a low-pressure turbine 19 and an exhaust nozzle 20. A nacelle 21 generally surrounds the engine 10 and defines both the intake 12 and the exhaust nozzle 20.

The gas turbine engine 10 works in the conventional manner so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place. There is an annular flow path 23 through the intermediate and high pressure compressors 14, 15.

The compressed air exhausted from the high-pressure compressor 15 is directed into the combustion equipment 16 where it is mixed with fuel and the mixture combusted. The resultant hot combustion products then expand through, and thereby drive the high, intermediate and low-pressure turbines 17, 18, 19 before being exhausted through the nozzle 20 to provide additional propulsive thrust. The high 17, intermediate 18 and low 19 pressure turbines drive respectively the high pressure compressor 15, intermediate pressure compressor 14 and fan 13, each by suitable interconnecting shaft. The annular flow path 23 extends through each of the high, intermediate and low pressure turbines 17, 18, 19.

Other gas turbine engines to which the present disclosure may be applied may have alternative configurations. By way of example such engines may have an alternative number of interconnecting shafts (e.g. two) and/or an alternative number of compressors and/or turbines. Further the engine may comprise a gearbox provided in the drive train from a turbine to a compressor and/or fan.

Figure 2:
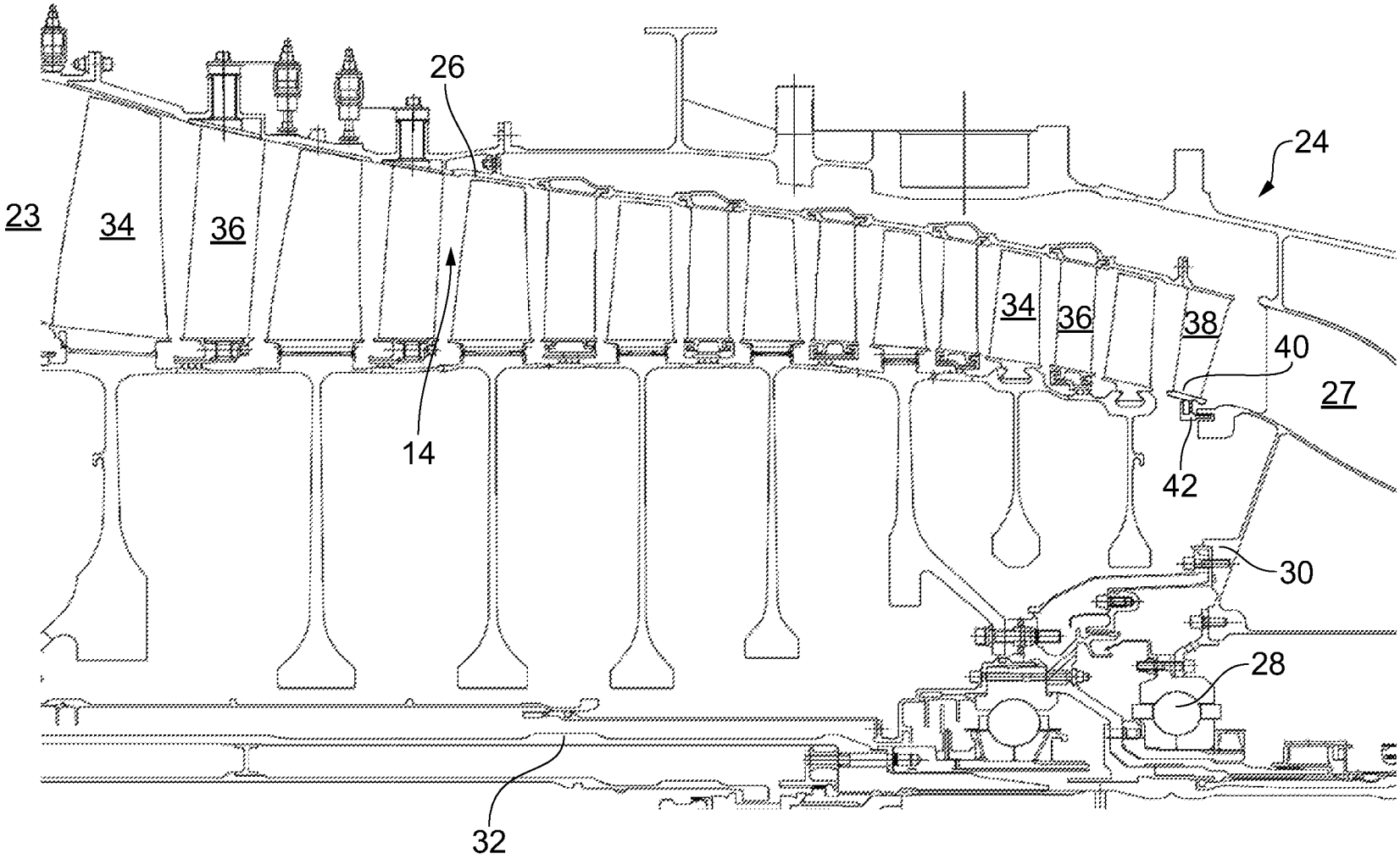
FIG. 2 is a sectional side view of the intermediate compressor of the gas turbine of FIG. 1.

FIG. 2 shows a side cross sectional view of the intermediate pressure (IP) compressor 14 together with a portion of an intercase 24.

The intercase 24 is a main structural component of the gas turbine engine 10 since it extends through the annular flow path to support the bearings and rotating shafts of the gas turbine engine. The intercase 24 is therefore a non-rotating structural component or body. The intercase 24 may comprise a plurality of different members or bodies coupled together, including a plurality of support members radially outside of and radially within the annular flow path 23.

As shown in FIG. 2, in this example the intercase 24 is structurally coupled to a radially outer casing 26 for the intermediate pressure (IP) compressor 14. For example, the outer casing 26 may be coupled to the intercase 24 by mechanical fasteners (such as bolts) or by joining, for example by welding. Axially downstream for the IP compressor 14, the intercase 24 comprises a "swan neck" duct 27 that forms the annular flow path from the IP compressor 14 to the high pressure compressor 15 (FIG. 1).

Radially within the swan neck duct 27, the intercase 24 forms a support structure 30 for a bearing assembly 28 that supports one or more rotating shafts 32 of the gas turbine engine 10 coaxially arranged around a centre axis A.

The IP compressor 14 comprises eight successive compressor stages, each stage comprising a disc of rotor blades 34 followed by an axially adjacent stator ring of stator vanes (stators) 36. Each disc of rotor blades 34 is coupled to a rotating shaft 32 of the turbine 10. Each stator ring 36 is coupled to the radially outer casing 26 (which is structurally coupled to the intercase 24) and extends radially inwardly into the annular flow path. For example, the stator rings 36 may have radially inner and radially outer platforms, circumferentially extending around the annular flow path. Each stator ring 36 may be formed of a plurality of ring sections and assembled into the casing 26 by slotting the radially outer platform into corresponding circumferentially extending slots in the casing 26.

In the final compressor stage, which in this example is the eighth, the stator ring 38 is disposed adjacent the swan neck duct 27 formed by the intercase 24. The radially inner end of the eighth stage compressor stator ring 38 is axially adjacent a portion of the intercase 24, such that a radially inner platform 40 of the eighth stator ring 38 and the intercase 24 form part of the radially inner profile of the annular flow path 23.

The radially inner end of the eighth stator ring 38 is not directly coupled to the axially adjacent portion of the intercase 24. One reason for this is that the intercase 24 and stator ring 38 may be composed of different materials having different thermal expansion coefficients. For example, the stator ring 38 may comprise stainless steel having a thermal expansion coefficient of $9.3\times10^{-6}K^{-1}$ whereas the intercase 24 may comprise titanium having a thermal expansion coefficient of $7.9\times10^{-6}K^{-1}$ Accordingly, the stator ring may expand at a different rate than the intercase 24 in response to an increase in temperature. In this example, the shroud 42 and intercase 24 comprise thermally-matched materials (i.e. materials having the same or similar thermal expansion coefficients), and in particular both comprise titanium. Accordingly, the amount of differential thermal expansion between the shroud 42 and the intercase 24 may be minimised. Nevertheless, owing to the small volume of the shroud 42 when compared to the intercase 24, the shroud 42 may heat up and cool down more rapidly than the intercase.

Further, since the stator ring 38 is not directly coupled to the intercase 24, it can be removed and maintained relatively easily and independently of the intercase 24.

In order to prevent an excessive leakage flow between the intercase 24 and the radially inner end of the eighth stator ring 38, a shroud 42 is provided therebetween. The shroud 42 allows relative movement between the radially inner end of the stator ring 38 and the intercase 24, whilst inhibiting flow through a clearance pathway 78 defined therebetween.

Figure 3:
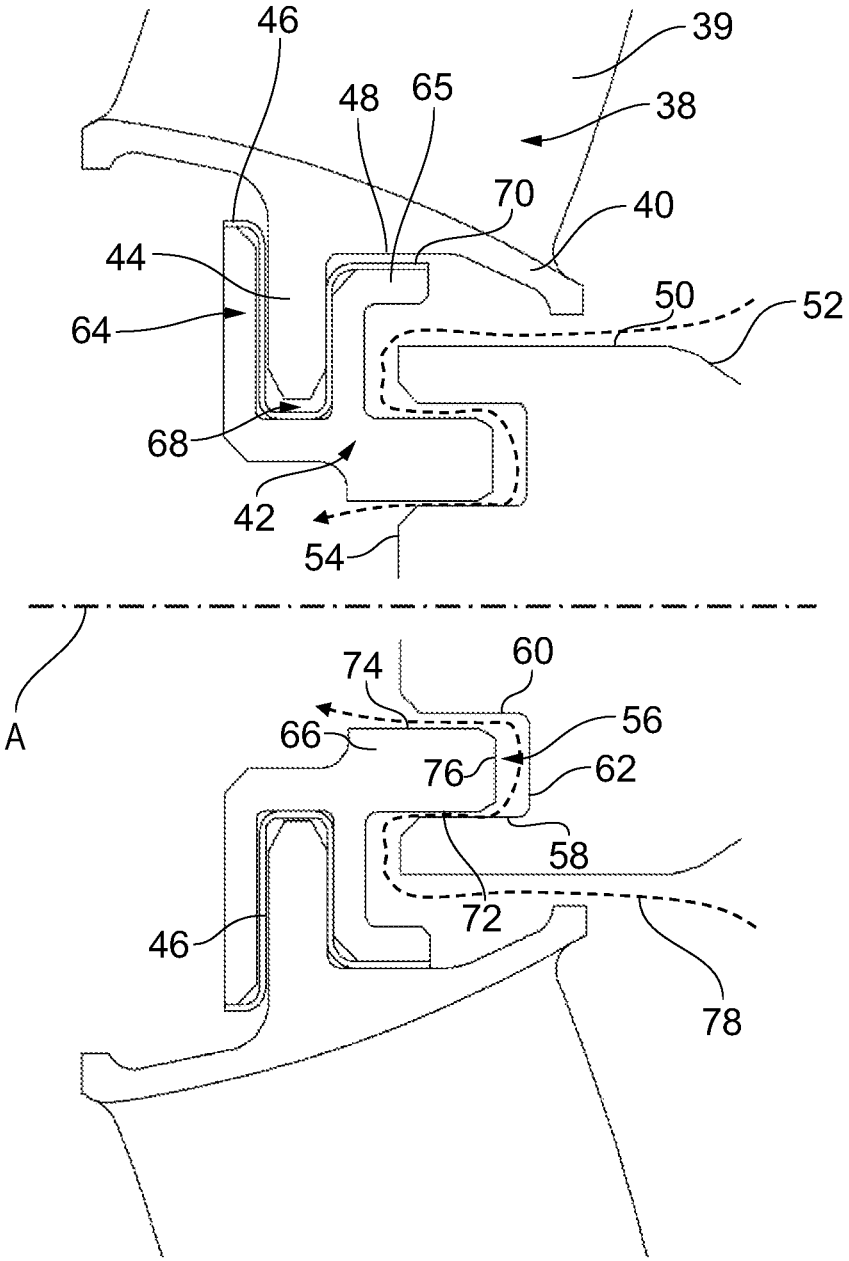
FIG. 3 is a split sectional side view of a shroud assembly of the intermediate compressor of FIG. 2.

FIG. 3 shows a radial cross-section of the shroud 42 engaged with the stator ring 38 and intercase 24 at upper and lower positions around the annulus of the gas turbine 10 when the centre axis A of the gas turbine 10 is oriented laterally.

As shown in FIG. 3, the stator ring 38 comprises an aerofoil portion 39 (or blade, vane) and a radially inner platform 40, the radially outer surface of which is gas-washed in use and defines a portion of the radially inner profile of the annular flow path 23. The platform 40 is generally inclined and convexly curved with respect to the axial direction (i.e. with respect to the centre axis A).

Radially within the platform 40, the stator ring 38 comprises a protruding leg or annular flange 44 that extends radially inwardly from the platform 40, and circumferentially extends around the centre axis. The flange 44 is located approximately axially centrally relative the axial extent of the platform 40. The flange 44 has a greater radial extent than axial extent, and has a tapered radially inner end to enable ease of location within a corresponding flange groove 68 defined the shroud 42, as will be described below.

In this example, the radially inner surface of the platform 40 on both axial sides of the flange 44 generally corresponds to the profile of the radially outer surface of the platform 40, except for a stator support surface 48 which is axially adjacent and downstream of the flange 44, and which extends substantially parallel with the centre axis A of the engine 10 so that it is substantially cylindrical. The cross-section of the platform 40 and flange 44 is substantially uniform around the annulus, such that the stator support surface 48 extends circumferentially around the annulus.

The portion of the intercase 24 axially adjacent the radially inner end of the eighth stator ring 38 (referred to simply as the intercase 24 with respect to the following description of FIG. 3) is disposed axially downstream of the flange 44 of the stator ring 38 and radially within the platform 40 so that there is a gap therebetween, and so that the platform 40 partially overlaps with the intercase 24. A radially outer surface 50 of the intercase 24 is disposed radially within the platform 40 and extends along a direction parallel with the centre axis A (i.e. in an axial direction) so that a portion 52 of the radially outer surface axially downstream of the platform 40 defines a radially inner profile of the annular flow path which corresponds to an upstream portion defined by the platform 40.

The intercase 24 defines an upstream side 54 extending substantially radially inwardly from the radially outer surface 50 so that it is substantially parallel with, and axially spaced apart from, the flange 44 of the stator ring 38. There is a rim groove 56 extending axially into the intercase 24 from the upstream side 54, the rim groove having a radially outer groove surface 58, a radially inner groove surface 60 and a downstream groove end 62.

In this example, the shroud 42 is approximately L-shaped in radial cross-section and comprises a stator seal portion 64 configured to cooperate with the stator ring 38, and a shoulder portion 66 configured to cooperate with the intercase 24.

In this particular example, the stator seal portion 64 has two radially extending walls defining a radially extending flange groove 68 (i.e. one having a radially outer opening) configured to receive the flange 44 of the stator ring 38. A shroud support portion 65 of the shroud 42 extends axially downstream from the lip of the flange groove 68 (i.e. from the radially outer end of the downstream radial wall of the stator seal portion 64) so that it is substantially cylindrical and lies radially within and opposing the stator support surface 48.

In this example the shroud comprises an anti-fret liner 46 which is received on the radially outer surfaces of the main body of the shroud and thereby defines the radially extending flange groove 68 and a shroud support surface 70 (overlying the shroud support portion 65) which opposes the stator ring 38. Accordingly, in use the flange 44 contacts the anti-fret liner 46, rather than the main body of the shroud itself. In this example, since the anti-fret liner 46 is received on the shroud support portion 65 of the shroud 42 it defines the radially outer shroud support surface 70 which opposes the stator support surface 48. In other examples there may not be such an anti-fret liner, and the support portion of the shroud may define the shroud support surface accordingly. In this particular example, the anti-fret liner 46 is approximately 0.375 mm thick, but in other examples may be of any suitable thickness, such as between 0.2 and 0.6 mm. In this example the anti-fret liner 46 comprises a nickel alloy, such as nickel alloy C263, a nickel-cobalt-chrime-molybdenum sheet alloy.

The shoulder portion 66 extends axially downstream from the radially inner end of the stator seal portion 64 to engage the intercase 24. In this example, the shoulder portion 66 is in the form of an annular rim 66 configured to be axially received in the annular rim groove 56 of the intercase 24. The rim 66 comprises a radially outer rim surface 72 configured to oppose the radially outer groove surface 58 of the annular rim groove 56, a radially inner rim surface 74 configured to oppose the radially inner groove surface 60, and a downstream rim end 76 sized so that it is axially spaced apart from the downstream groove end 62.

The stator ring 38, shroud 42 and intercase 24 are configured to cooperate with each other so that the shroud 42 can move radially with respect to both the stator ring 38 and intercase 24, the shroud 42 is supported on the stator ring 38 (i.e. by contact therewith) and the shroud 42 does not contact the intercase 24. In addition, the stator ring 38 and shroud 42 can move (together) axially with respect to the intercase 24, for example, owing to differential thermal expansion between the casing 26 for the compressor 14 and the intercase.

The stator ring 38, shroud 42 and intercase 24 are assembled together so that, if coaxially arranged, there is a radial clearance between the components. In particular, there is a first radial clearance between the stator support surface 48 and the shroud support surface 70 (formed by the anti-fret liner 46, in this example); a second radial clearance between the opposing radially outer rim surface 72 and the radially outer groove surface 58; and a third radial clearance between the opposing radially inner rim surface 74 and the radially inner groove surface 60. In this example, the second and third radial clearances are the same, and are approximately 2 mm each. In this example, the first radial clearance (between the stator ring 38 and shroud 42) is between 0.8 mm and 1 mm, depending on the operating conditions and therefore the temperature of the stator ring 38. Further references to clearances below are based on a first radial clearance of 1 mm. In other examples, the radial clearances may be higher or lower (whilst the first radial clearance remains less than the second and third radial clearances). For example, the first radial clearance may be between 0.1 mm and 10 mm, such as between 0.1 mm and 1 mm, whereas the second and third radial clearances may be between 0.2 mm and 15 mm, such as between 0.2 mm and 2 mm.

The first radial clearance is less than the second and third radial clearance. Whilst the stator ring 38 and intercase 24 are only able to move relative one another owing to differential thermal expansion (since the stator ring 38 is mounted to the outer casing 26, which structurally mounted to the intercase 24) and buffeting of the stator ring 38, the shroud 42 is able to move relative the stator ring 38 and intercase 24 within limits defined by its engagement with the stator ring 38.

When the axis of the gas turbine 10 extends substantially laterally (as is conventional), the shroud 42 tends to drop downwards under gravity.

Accordingly, considering the angular positions of the annular components (i.e. the stator ring 38, shroud 42, intercase 24) with respect to a clock-face, the shroud 42 may move down into a dropped configuration in which a portion of the shroud support surface 70 at the 6 o'clock position abuts a corresponding portion of the stator support surface 48 so that the shroud 42 is supported on the stator ring 38. With the shroud in this dropped configuration, the radial clearance between the stator support surface 48 and the shroud support surface at the 12 o'clock position is double that of the coaxial arrangement (i.e. 16 mm).

Similarly, the radial clearance between the radially outer groove surface 58 and the opposing radially outer rim surface 72 at the 12 o'clock position grows to 3 mm (i.e. the original 2 mm clearance plus 1 mm corresponding to the downward movement of the shroud), as does the radial clearance between the radially inner groove surface 60 and the radially inner rim surface 74 at the 6 o'clock position. Conversely, the radial clearance between the radially outer groove surface 58 and the opposing radially outer rim surface 72 at the 6 o'clock position shrinks to 1 mm (i.e. the original 2 mm clearance minus 1 mm corresponding to the downward movement of the shroud), as does the radial clearance between the radially inner groove surface 60 and the radially inner rim surface 74 at the 12 o'clock position.

The rim 66 and rim groove 56 are configured so that there is an axial clearance between the rim 66 and rim groove 56, in particular between the rim end 76 and groove end 62, that is greater than the operational axial relative movement between them.

The flange groove 68 of the stator seal portion 64, the anti-fret liner 46 and the flange 44 of the stator ring 38 are sized to cooperate so that a seal is formed therebetween whilst the shroud and anti-fret liner are able to move radially relative the stator ring 38 (i.e. a close sliding fit). Accordingly, in use there is no flow between the stator ring and the shroud 42.

In contrast and as described above, radial movement of the shroud 42 is limited by contact with the stator ring 38 so that the rim 66 of the shroud 42 fails to contact the surfaces of the rim groove 56 of the intercase 24, and so that a clearance pathway 78 is maintained between the rim 66 and the rim groove 56 of the intercase 24.

The rim 66 projects into the rim groove 56 so that the clearance pathway 78 is circuitous, thereby inhibiting flow through the clearance pathway 78.

In use, the shroud 42 moves to the dropped position under gravity. As the temperature of gas along the annular flow path 23 rises, the stator ring 38 expands at a different rate to the shroud 42 and intercase 24, and therefore the radial clearance between the shroud 42 and the stator ring 38 at a different rate.

As described above, the shroud 42 is supported on the stator ring 38, and so moves with the stator ring 38 as it thermally expands. Further, vibrations of the stator ring 38 caused by buffeting of the stator ring 38 are translated to the shroud 42.

The shroud 42 does not contact the intercase 24, and in particular a clearance pathway 78 is maintained between the rim 66 of the shroud and the corresponding groove of the intercase 24, as described above. Accordingly, movement of the shroud 42 relative the intercase 24 does not lead to wear of the rim 66 or the intercase 24. Consequently, the maintenance requirement the intercase 24, which is a large and therefore complex piece of equipment, is minimised.

Further, since the shroud 42 is supported against one component only (the stator ring 38), as opposed to held between two components, wear of the shroud is minimised.

Although an example gas turbine engine has been described in which a shroud is disposed between an intercase and compressor stator ring, it will be appreciated that the shroud arrangement disclosed herein may be applied in other axial flow machines, and in both turbines and compressors. Further, the shroud may be disposed between a stator and a body other than an intercase, such as between a combustor casing and a vane of a turbine stage.

Further, whilst an example has been described in which the shroud comprises a flange groove for receiving a flange of a stator ring, it will be appreciated that in other embodiments a flange of the shroud may be received in a flange groove of a stator ring. Similarly, whilst the above example refers to a rim of the shroud being received in a corresponding rim groove of the intercase, it will be appreciated that the rim and rim groove may be inverted.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

What is claimed is:

1. An axial flow machine comprising:
an annular flow path;
a stator ring comprising a plurality of stators, each stator mounted at a radially outer end of each stator and extending into the annular flow path;
a non-rotating body axially adjacent the stator ring;
an annular shroud disposed between a radially inner side of the stator ring and the body; wherein
the shroud is supported on the stator ring and moveable relative the body;
the shroud cooperates with the body to inhibit a flow through a clearance pathway therebetween;
the stator ring overlaps the body in a radial direction,
the non-rotating body and the stator ring are coaxially arranged about a center axis of the axial flow machine, and the radial direction is perpendicular to the center axis of the axial flow machine,
the stator ring, shroud, and body are configured so that, when coaxially arranged, there is a first radial clearance between the stator ring and the shroud which is less than a second radial clearance between the shroud and the body, and
the second radial clearance overlaps the stator ring in the radial direction.

2. An axial flow machine according to claim 1, wherein a seal is formed between the stator ring and the shroud.

3. An axial flow machine according to claim 2, wherein the shroud comprises an anti-fret liner to form a seal between the shroud and the stator ring.

4. An axial flow machine according to claim 1, wherein the shroud is radially moveable relative the stator ring.

5. An axial flow machine according to claim 1, wherein the stator ring comprises a radially inner platform defining a portion of the annular flow path, and wherein the stator ring and shroud are engaged radially inward of the platform by a cooperating radially extending flange and radially extending flange groove.

6. An axial flow machine according to claim 5, wherein the stator ring comprises the flange, and the shroud comprises the flange groove.

7. An axial flow machine according to claim 5, wherein the shroud comprises a circumferentially extending shroud support surface and the stator ring comprises an opposing circumferentially extending stator support surface; and wherein the shroud is offset from coaxial alignment with the stator ring so that at least part of the shroud support surface is supported on at least part of the stator support surface; and wherein the stator support surface and the shroud support surface are axially adjacent the cooperating flange and flange groove, and wherein the shroud and the stator ring are configured so that there is a radial clearance between a radial end of the flange and the flange groove.

8. An axial flow machine according to claim 5, wherein the shroud comprises a stator seal portion defining one of the flange and the flange groove, and a shroud support portion extending axially away from the stator seal portion and configured to oppose and be supported on the stator ring.

9. An axial flow machine according to claim 1, wherein the shroud comprises a circumferentially extending shroud support surface and the stator ring comprises an opposing circumferentially extending stator support surface; and
wherein the shroud is offset from coaxial alignment with the stator ring so that at least part of the shroud support surface is supported on at least part of the stator support surface.

10. An axial flow machine according to claim 9, wherein a gas-washed surface of the platform defining the annular flow path is inclined and/or curved relative a centre axis of the axial flow machine when viewed in radial crosssection, and wherein the stator support surface extends linearly and/or axially when viewed in radial cross-section.

11. An axial flow machine according to claim 1, wherein
the shroud comprises a circumferentially extending shroud support surface and the stator ring comprises an opposing circumferentially extending stator support surface, the shroud support surface and the stator support surface limiting a radial movement of the shroud; and
the shroud and the body comprise opposing surfaces at least partly defining the clearance pathway therebetween, the opposing surfaces extending circumferentially.

12. An axial flow machine according to claim 11, wherein the shroud and the body comprise a rim and a cooperating rim groove which receives the rim, wherein the clearance pathway is defined between the rim and rim groove, one of the shroud and the body comprising the rim, and the other comprising the rim groove; and wherein the opposing surfaces that define the clearance pathway include radially inner and outer surfaces of the rim and opposing radially inner and outer surfaces of the rim groove respectively.

13. An axial flow machine according to claim 1, wherein the shroud and the body comprise opposing surfaces at least partly defining the clearance pathway therebetween, the opposing surfaces extending circumferentially.

14. An axial flow machine according to claim 1, wherein the shroud and the body comprise a rim and a cooperating rim groove which receives the rim, wherein the clearance pathway is defined between the rim and rim groove, one of the shroud and the body comprising the rim, and the other comprising the rim groove.

15. An axial flow machine according to claim 14, wherein the shroud comprises the rim and the body comprises the rim groove.

16. An axial flow machine according to claim 1, wherein the stator ring, shroud and body are axially arranged with respect to each other.

17. An axial flow machine according to claim 1, wherein the body is coupled to or part of an intercase extending through the annular flow path to support a shaft of the axial flow machine.

18. A gas turbine engine incorporating an axial flow machine comprising:
an annular flow path;
a stator ring comprising a plurality of stators, each stator mounted at a radially outer end of each stator and extending into the annular flow path;
a non-rotating body axially adjacent the stator ring;
an annular shroud disposed between a radially inner side of the stator ring and the body; wherein
the shroud is supported on the stator ring and moveable relative the body;
the shroud cooperates with the body to inhibit a flow through a clearance pathway therebetween;
the stator ring overlaps the body in a radial direction;
the non-rotating body and the stator ring are coaxially arranged about a center axis of the axial flow machine, and the radial direction is perpendicular to the center axis of the axial flow machine;

the stator ring, shroud, and body are configured so that, when coaxially arranged, there is a first radial clearance between the stator ring and the shroud which is less than a second radial clearance between the shroud and the body; and the second radial clearance overlaps the stator ring in the radial direction.

19. A gas turbine engine according to claim 18, wherein the body is coupled to or part of an intercase of the gas turbine engine.

20. An axial flow machine according to claim 1, wherein the shroud includes (i) a shroud support portion including a shroud support surface facing radially outward, and (ii) a rim spaced apart from the shroud support potion in the radial direction, the rim including an inner rim surface facing radially inward, the shroud support surface and the inner rim surface overlapping in the radial direction.

* * * * *